United States Patent [19]

Botzem et al.

[11] 4,456,827

[45] Jun. 26, 1984

[54] TRANSPORTATION AND/OR STORAGE CONTAINERS FOR RADIOACTIVE MATERIAL

[75] Inventors: Werner Botzem, Alzenau; Reiner Laug; Hartmut Kroll, both of Hanau; Elmar Schlich, Gründau; Walter Anspach, Hanau; Karl Brendel, Muhlheim; Peter Srostlik, Maintal, all of Fed. Rep. of Germany

[73] Assignee: Transnuklear GmbH, Hanau, Fed. Rep. of Germany

[21] Appl. No.: 282,015

[22] Filed: Jul. 10, 1981

[30] Foreign Application Priority Data

Jul. 11, 1980 [DE] Fed. Rep. of Germany ... 8018593[U]

[51] Int. Cl.[3] ..... G21F 5/00

[52] U.S. Cl. ..... 250/506.1; 376/272

[58] Field of Search ..... 250/506.1, 507.1; 376/272

[56] References Cited

U.S. PATENT DOCUMENTS

| | | | |
|---|---|---|---|
| 3,982,134 | 9/1976 | Householder et al. | 250/506 |
| 4,274,007 | 6/1981 | Baatz et al. | 250/506 |
| 4,330,711 | 5/1982 | Ahner et al. | 250/506 |

*Primary Examiner*—Bruce C. Anderson

*Attorney, Agent, or Firm*—Cushman, Darby & Cushman

[57] ABSTRACT

An improved container for transportation or storage of radioactive substances, especially spent nuclear fuel elements, has a cylindrical open-top thick-wall metallic body for shielding gamma radiation. A liner for the container has a top peripheral flange engaged with the bottom of a counterbore in the container open top. A thick gamma-ray shielding cover for the lining is disposed in the counterbore and screw means detachably secure both the lining flange and the cover to the body independently. The body has exterior generally parallel spaced cooling fins transversely intersected by flanges of lesser height to minimize fin cracks extending into the body. Neutron shielding is disposed in the exterior spaces between the fins and the flanges.

2 Claims, 11 Drawing Figures

TRANSPORTATION AND/OR STORAGE CONTAINERS FOR RADIOACTIVE MATERIAL

BACKGROUND OF THE INVENTION

This invention relates to an improved transportation and/or storage container for radioactive substances, especially for irradiated fuel elements from nuclear reactors.

Containers which are used for the transportation and/or storage of spent nuclear fuel elements must safely enclose the radioactivity of such elements and ensure such safe enclosure even in the event of an extreme accident. Such containers not only must shield or prevent exterior emissions of the gamma-and n-radiation being given off by radioactive decomposition reactions of such elements but also must transfer safely to the outside the heat generated by such reactions.

Known containers, as disclosed for example by the German Pat. OS No. 22 28 026, have open-top thick-walled metallic container bodies closed by a thick metallic removable cover to ensure the necessary strength and shielding against gamma rays. The bodies are provided with exterior cooling ribs or fins and shielding against neutrons. They also are provided with an interior lining for protection against corrosion and to facilitate decontamination. For reasons of handling, testing and storing, the interior linings preferably ae constructed as removable inside containers or enclosures.

These prior containers have a number of disadvantages. The interior lining is fastened in the container body either by clamping elements holding it down or else attached by screws in the area of the container cover, both of which expedients are expensive. Thus, for example in the case of attachment with screws, two rows of tapped holes are necessary; one row to fasten the inside lining firmly to the body and the other row to fasten the cover to the container body. Besides this expensive fastening arrangement, a further disadvantage is that the inside lining is perforated by holes for the screws, and thus the container body is exposed to attack by corrosion. Also, the space requirements for such a screw attchement system are undesirably large.

An additional disadvantage of know containers is the fact that the gap or interspace between the container body and the inside lining cannot be monitored, which limits the use of such containers for storage purposes because of the lack of or the possibility of only incomplete integrity tests during the storage time which often lasts several years.

Furthermore, in hitherto known containers having welded-on or cast-on cooling ribs, there exists the danger in the case of an accident, for example, a container is dropped and cracks or breaks off one or more cooling ribs, that a crack may continue into the container body, representing the tight enclosure of the radioactive substances.

BRIEF SUMMARY OF THE INVENTION

Therefore, it is an object of the present invention to create a improved transportation and/or storage container for radioactive substances, especially for irradiated fuel elements from nuclear reactors.

It is another object of this invention to provide such a container with a removable inside lining that is attached in a manner to minimize any corrosive attack on the container body, that minimizes attachment space requirements for both the lining and th container cover, and that simplifies handling of the lining and the cover.

It is another object of this invention to provide such a lined container that is constructed to permit monitoring of the interspace between the lining and the container body to test the integrity of the lining.

It is another object of this invention to provide such a container with cooling ribs and means for minimizing the possibility of a rib crack continuing into the body of the container.

The foregoing objects are accomplished by an open-top thick-walled metallic container body having an open-top removable lining. The lining has a top peripheral flange overlying the container body. A detachable cover for the lining overlies and is sealed to the flange. Fastening means for the cover and the lining are located outwardly of the seal. A detachable cover for the container body overlies the lining cover and is provided with an opening having a removable closure for monitoring the interspace between the two enclosures, one formed by the lining and its cover and the other by the container body and its cover. The container body is provided with spaced exterior cooling ribs or fins and spaced flanges of lesser height than the ribs interconnecting the latter to inhibit crack off of a rib at its base, i.e. at the container's outer surface, and so minimize the continuation of a rib rack into the container body. Neutron shielding material is located conveniently between the ribs and the flanges.

Other objects and advantages of the invention will become evident from the following description and accompanying drawings in which:

DETAILED DESCRIPTION OF THE INVENTION

Figure 1:
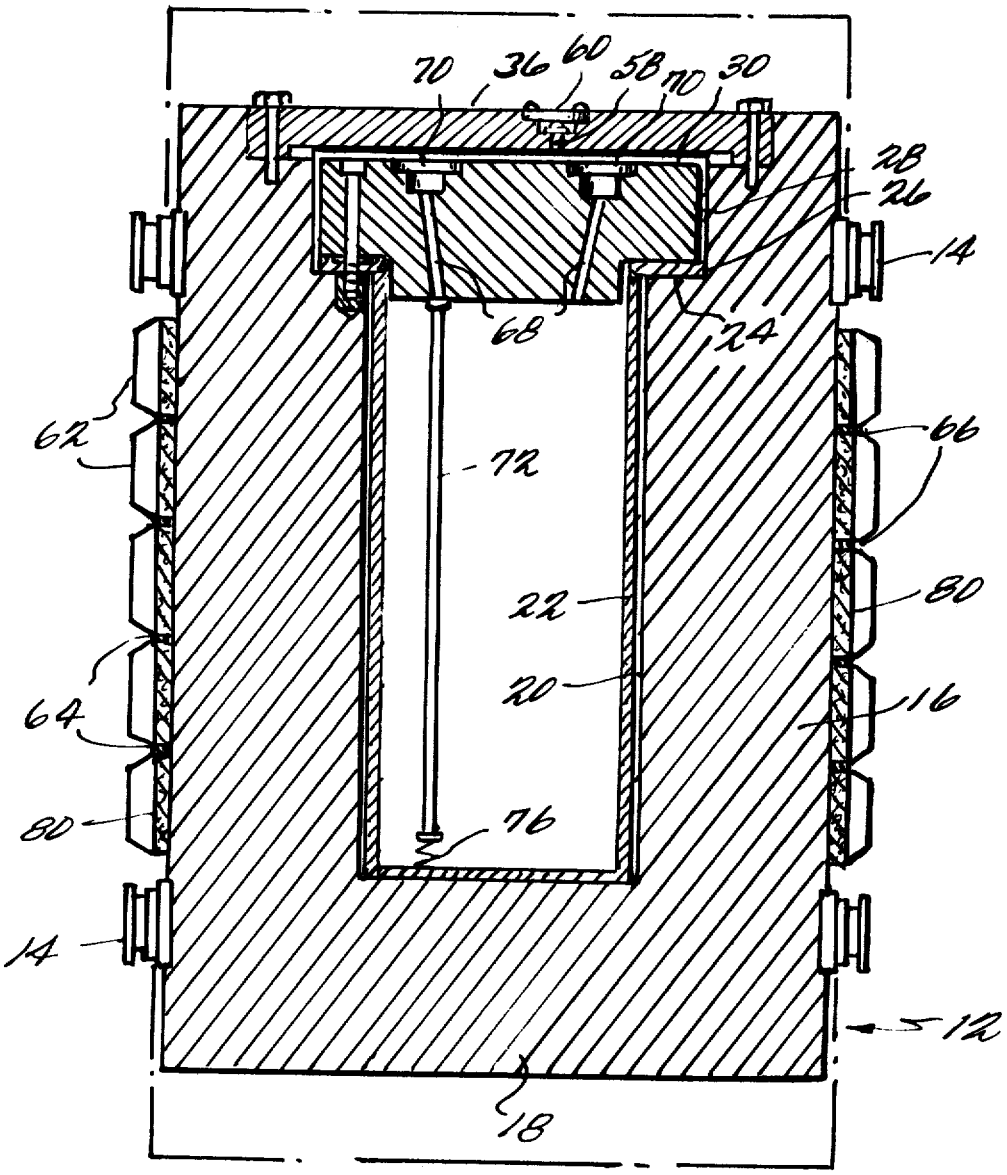
FIG. 1 is a somewhat schematic vertical sectional view of a container embodying this invention.
Figure 2:
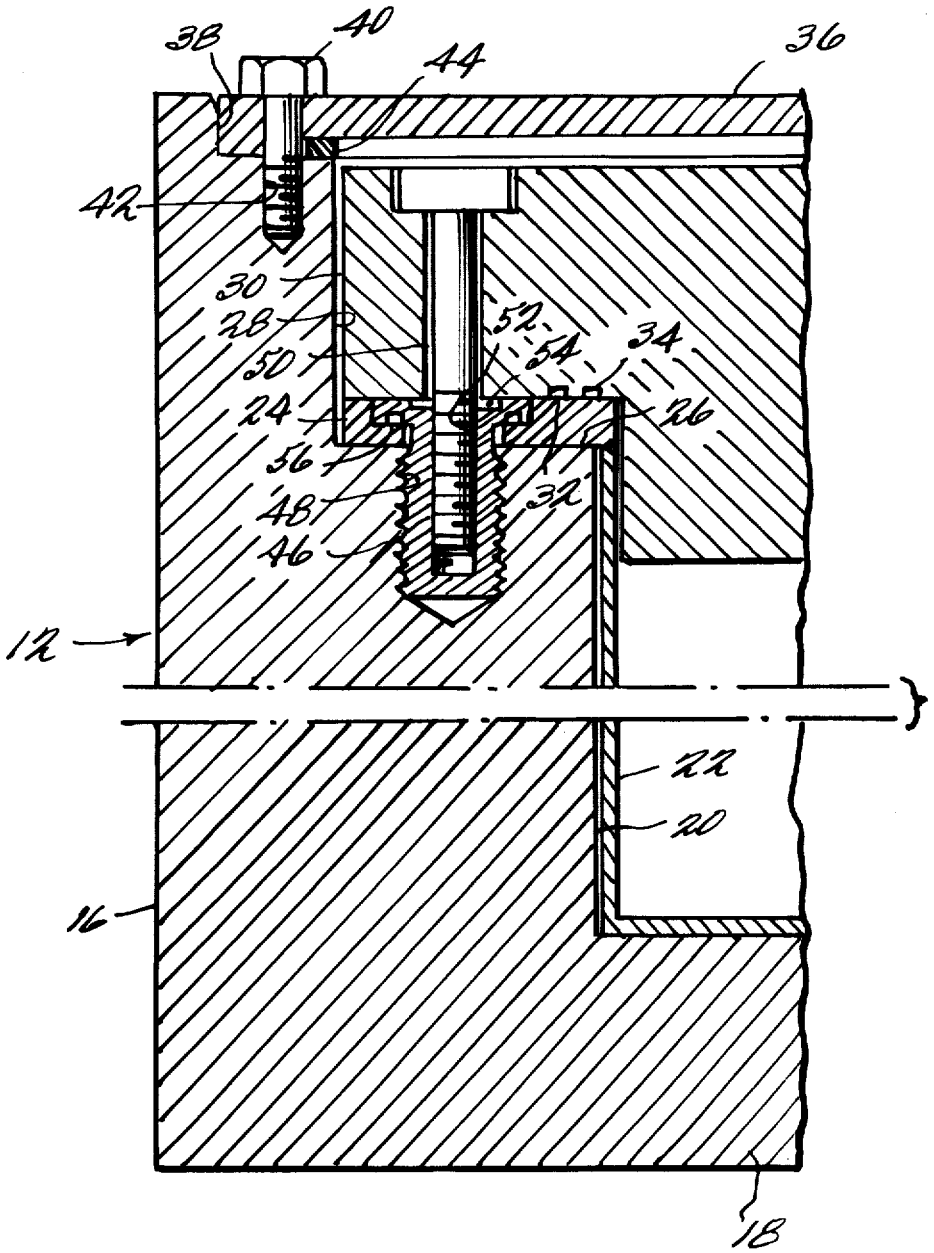
FIG. 2 is an enlarged fragmentary view of a portion of FIG. 1 showing details of the means for fastening the lining and its cover in the container.

Referring now to the drawings, a transportation and/or storage container embodying this invention comprises mainly a thick-wall container body 12 of metallic material for containing therein and shielding gamma radiation of radioactive material. The material of the body 12 desirably is made of cast iron, preferably spherical graphite cast iron. The container body 12 preferably is cylindrical, is provided with the usual trunnion-like supporting projections 14 and has an open top and side walls 16 integral with a bottom 18 defining an interior cylindrical cavity 20 for the reception of radioactive material, e.g., spent nuclear fuel elements. The cavity 20 is provided with a corrosion resistant open-top lining 22 provided with a top peripheral flange 24 overlying the bottom 26 of a counterbore 28 in the open top of the container body 12. A thick gamma-radiation-shielding cover 30 for the lining 22 is fitted into the counterbore 28 in overlying engagement with the flange 24. Sealing means are provided between the lining cover 30 and the flange 24 adjacent the inner periphery of the latter, such as resilient sealing gaskets 32, e.g., O-rings, disposed in concentric annular grooves 34 in the underside of the cover. A container body or outside cover 36, preferably of the same material as the container body 12, overlies the lining cover 30 in an outer counterbore 38 in the top of the container body. This container body cover 36 may be secured in place by screws 40 engaged within threaded sockets 42 in the container body 12. Sealing means, such as resilient sealing gaskets 44, are interposed between the body cover 36 and the bottom 38 of the outer counterbore inwardly of the screws 40.

The lining 22 is detachably fastened in the container body 12 by a circular array of countersunk headed screws 46 extending through the flange 24 into tapped sockets 48 in the container body. These sockets 48 are sealed against corrosion from the contents of the lining 22, and its cover 30, by the seals 32. The lining cover 30 is secured in place by a circular array of headed screws 50 which extend through the cover into tapped sockets 52 in the screws 46. Thus, the interior lining 22 and its cover 30 are secured to the body 12 independently of one another but in a manner which minimizes attachement space and assures against corrosion of the body 12 of the container by the contents of the lining. Preferably, the socketed screws 46 are made of corrosion resistant material. In actual practice, it has been found that the lining cover 30 may be secured in place by 24 M32 screws 50. In the event, the socketed screws 46 may be M48. With this arrangement, the cover screws 50 may be unscrewed readily without unscrewing the socketed lining screws 46.

The head of each of the socketed screws 46 is shaped, as at 54, for engagement by a suitable wrench for easy screwing and unscrewing. Preferably a sealing gasket 56 is interposed between the under side of the head of the socketed screws 46 and the bottom of the corresponding countersink in the liner flange 24 to seal against admission of water into the tapped sockets 48 in the event the container is loaded with spent nuclear fuel elements while under water. The tapped sockets 52 in the screws 46 may have closed inner ends, as shown in the drawings, or such sockets may be replaced by open ended tapped bores.

As shown in FIG. 1, the container body cover 36 preferably is provided with an aperture 58 having a removable sealing closure 60 which comprises a connection for monitoring the interspace between the two enclosures; an outer enclosure formed by the container body 12, the cavity 20 therein and its cover 36, and an inner enclosure formed by the lining 22 and its cover 30. Thus, it is possible, by way of the connection 58, to ascertain the integrity of the inner enclosure with a conventional search device for radioactive leakage without exposing an operator to radiation danger. Consequently, the container is suitable for intermediate storage of radioactive material which is to be reprocessed later.

Figure 3:
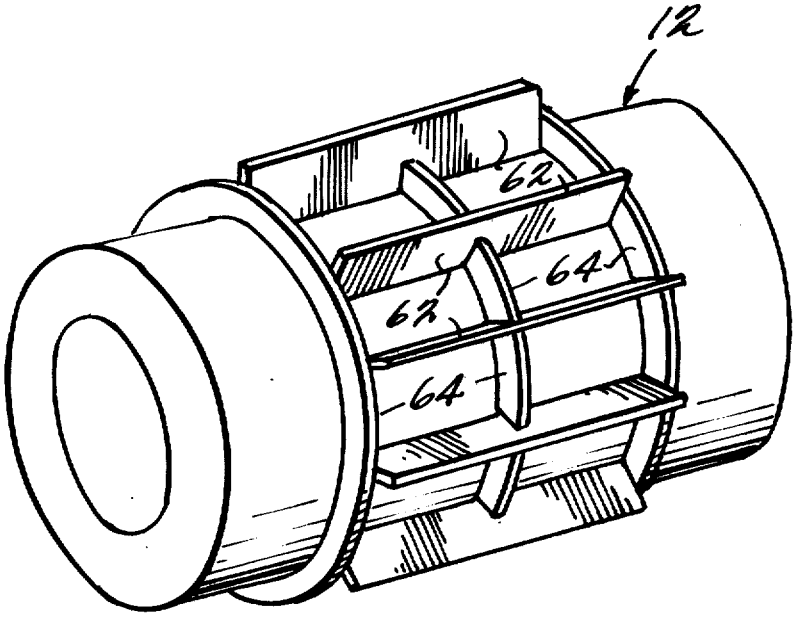
FIG. 3 is a perspective schematic view of the container shown in FIG. 1.
Figure 4:
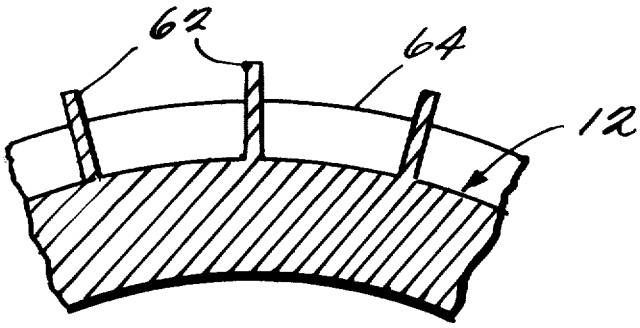
FIG. 4 is an enlarged fragmentary transverse sectional view of the wall and exterior cooling ribs of the container body shown in FIG. 3.

Referring now to FIGS. 3 and 4 of the drawings, the body 12 of the container, which preferably is cylindrical, is provided with a plurality of preferably equally-spaced exterior cooling ribs or fins 62 which may be arranged longitudinally, as shown, or circumferentially. These ribs 62 may be either cast integrally with the body 12 or welded thereto. Extending transversely to and between the ribs 62 and secured to the latter and to the exterior of the container body 12 are bridges or flanges 64 of a height less than that of the cooling ribs. These flanges 64 preferably are cast integrally with the body 12 and ribs 62, or they may be welded in place.

The presence of the flanges 64 insures that in the event of the breaking off or cracking off of a cooling rib 62, the line of fracture of such rib is not located at its base but at a distance above such base. This minimizes the possibility that the breaking off or cracking off of a rib 62, which may occur in the event the container is dropped, will extend the fracture into the container body 12, i.e. insures against the continuation of such a crack into the container body. The safe distance of such a rib crack from the container body 12 itself can be insured by the judicious selection of relative heights of the flanges 64 and the ribs 62. Theoretical calculations, and also experiments, have shown that it is desirable to proportion the parts such that the height of the flanges 64 is no more than about two-thirds of the height of the cooling ribs 62 and that the spacing between flanges is no more than about ten times their height.

Figure 5:
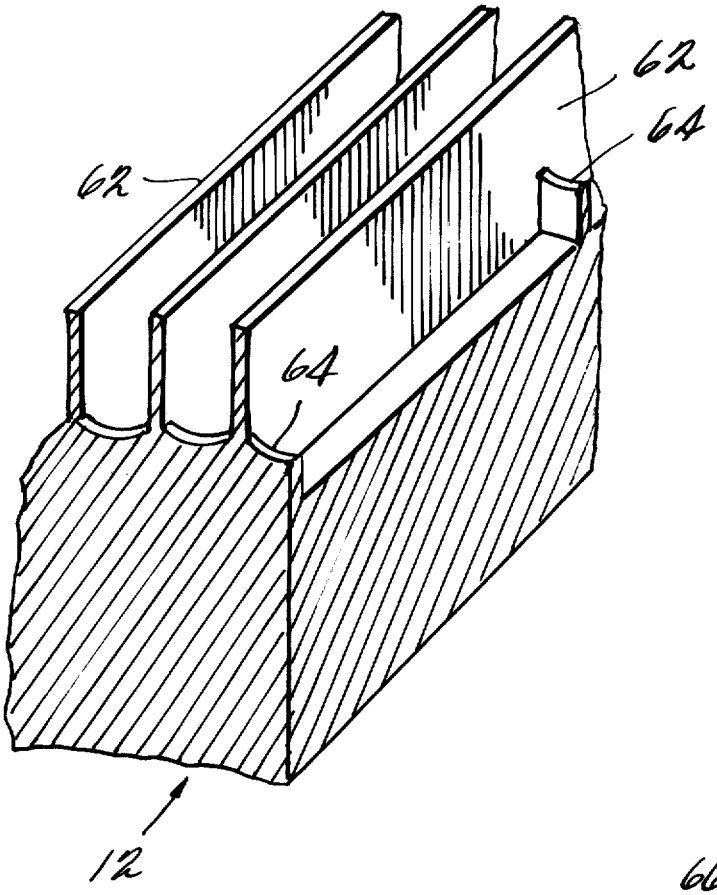
FIG. 5 is an enlarged fragmentary perspective view, partly in section, showing the side wall and cooling ribs of the container body shown in FIG. 3.

In connection with the foregoing provision for inhibiting the extension of rib fracture cracks into the body 12 of the container, it has been found to be advantageous to provide notches 66 in the cooling ribs 62 in the area of intersection therewith of the flanges 64, as shown in FIG. 5. This construction even better insures against continuation of a rib crack into the body 12 of the container. The bottom of the notches 66 is no deeper than the tops of the flanges 64. Notches 66 of lesser depth are effective for their intended purpose, however, depending upon the specific design and material of the ribs 62 and flanges 64. Such notches 66 may be molded by a casting operation or formed by a machining operation.

In a working example, a cast body container for irradiated nuclear fuel elements taken from a pressurized water reactor, the container having cast on longitudinal cooling ribs and circumferential flanges, may have flange spacing of the order of about 440 mm and a flange height of about 70 mm. The cooling ribs may have a height of about 240 mm with notches therein, at the location of intersection of the flanges, of a depth of the order of about 95 mm. With these dimensions, potential cracks in the container body 12, occasioned by damage to the cooling ribs, will be avoided.

Figure 6:
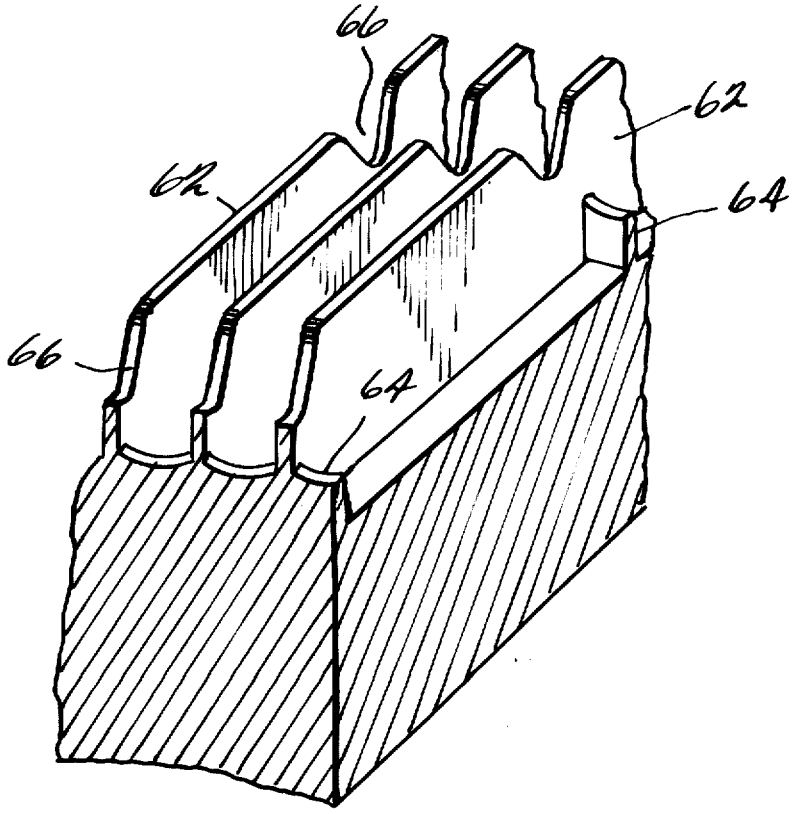
FIG. 6 is a view, corresponding to FIG. 5, showing a modification of the cooling ribs of a container embodying this invention.
Figure 7:
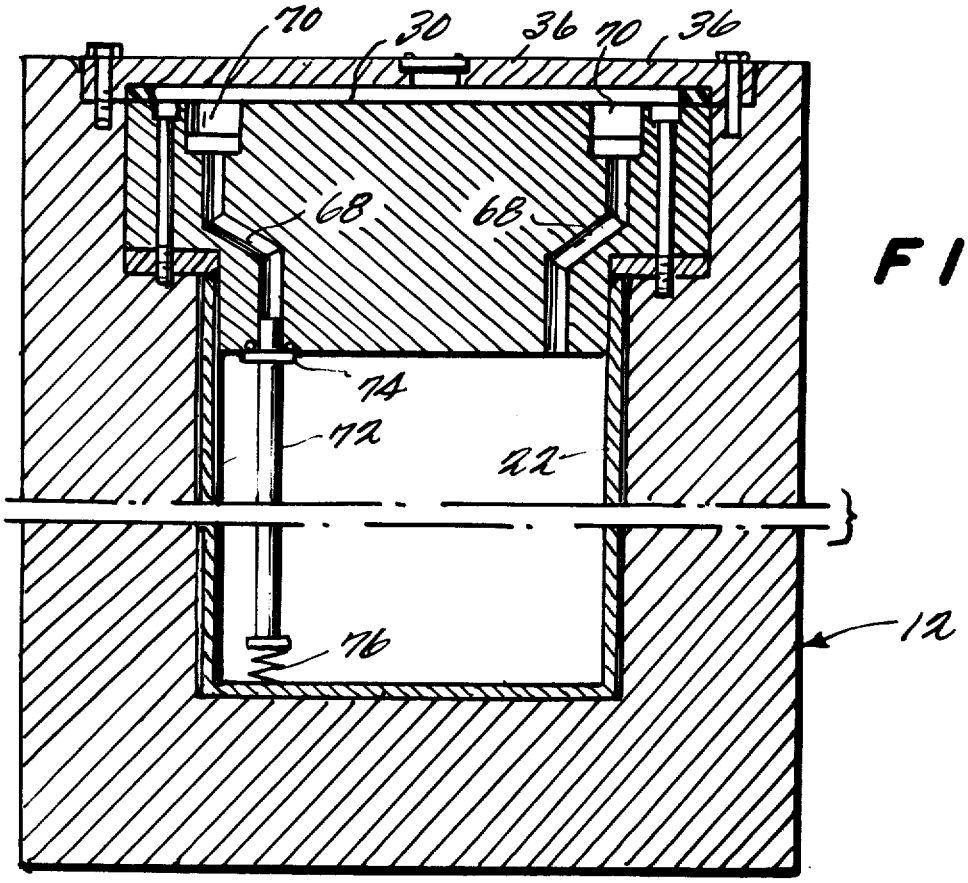
FIG. 7 is an enlarged fragmentary view of a portion of FIG. 1 showing details of the supply lines.
Figure 8:
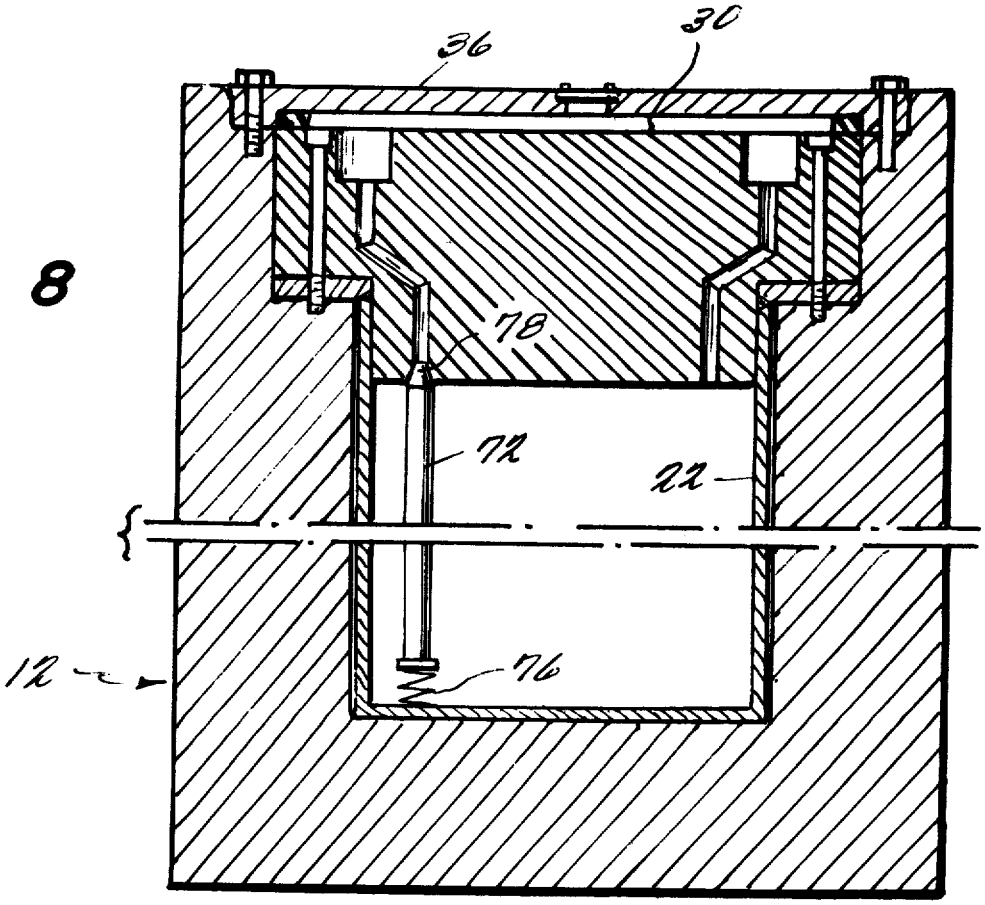
FIG. 8 is a view corresponding to FIG. 7 showing a modification of the supply lines.
Figure 9:
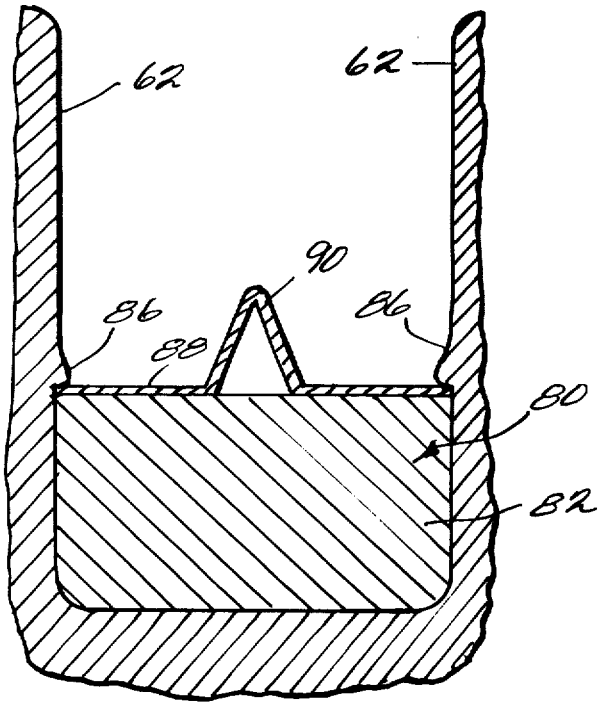
FIG. 9 is an enlarged fragmentary sectional view showing details of the arrangements for neutron shielding located on the exterior of the main body of the container.

Connections also are made through the lining cover 30 to the interior of the lining 22. These include supply passages 68 through the cover 30, the outer end of each being provided with a removable closure 70. A rigid line, pipe or tube 72 is connected to the inner end of one of the passages 68 and depends to a location adjacent the bottom of the lining 11. The upper end of the tube 72 is inserted into the inner end of the passage 68 with a flange 74 on the tube determining the depth of insertion. A coil compression spring 76 is interposed between the lower end of the tube 72 and the lining bottom to retain the tube in place, as shown in FIGS. 1 and 6. Alternatively, the inner end of the passage 68 may terminate in an outwardly flaring cone 78 and the tube 72 may have an upper end complimentary to and fitting in the cone, as shown in FIG. 7.

Figure 10:
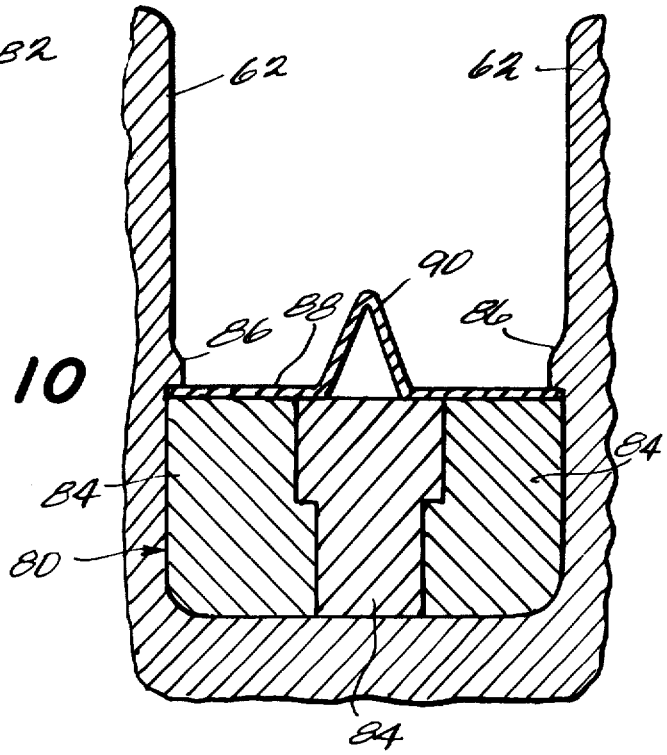
FIG. 10 is a view corresponding to FIG. 9 of a modification of the neutron shielding arrangement shown in FIG. 8.

Neutron shielding material 80 desirably covers the cylindrical outer surface of the container body 12, preferably being disposed between the cooling ribs 62 in the spaces between the flanges 64 and the upper ends of ribs. It is particularly desirable to construct the neutron shielding material 80 in the form of molded bodies 82 to fit in such spaces, and even more desirable to form the bodies of several individual closely fitting parts 84 as shown in FIG. 10. Thus the neutron shielding 80 can be easily mounted, tested and serviced. The several parts 84 may have a variable shape, graduation and size, but should be fitted together into an ensemble which will shield stray neutrons. The molded bodies 82 preferably are held in place by engagement beneath lateral projections 86 on the cooling ribs 62, and may have a covering thereon (not shown) retained in place by such projections. Spring clips 88 having a folded or ridge-shaped resilient central portion 90 may be used effectively to retain multi-part molded bodies 84 in place, the ridge-like resilient portion 90 serving additionally as a mini-cooling rib.

Figure 11:
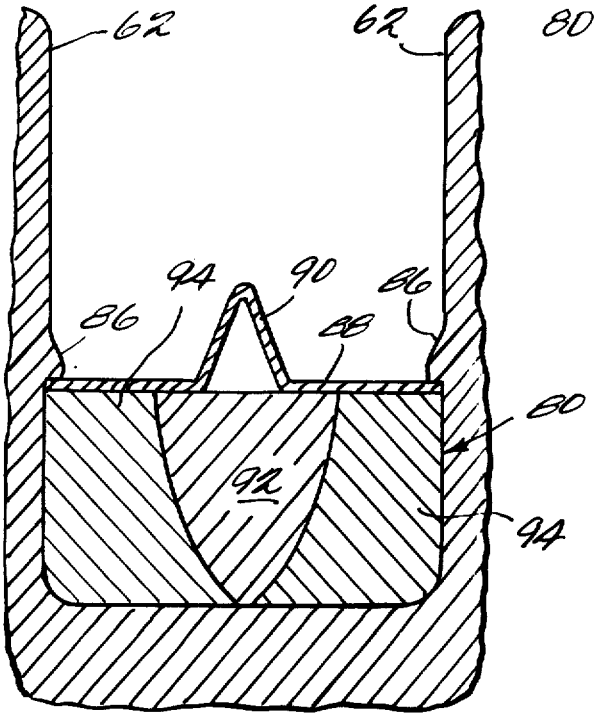
FIG. 11 is a view corresponding to FIG. 9 of another embodiment of a neutron shielding arrangement.

In a preferred embodiment, shown in FIG. 11, the multi-part molded body 82 may comprise a middle part 92 that is parabolic or cuniform in cross section and two identical parts 94 on the opposite sides of the middle part. The middle part 92 may be slightly oversize so that the force exerted thereon by the clip 88 will press the lateral parts 94 tightly against the outer surface of the body 12 and against the cooling ribs 62.

We claim:

1. A transportation and/or storage container for radioactive substances, especially for irradiated fuel elements from nuclear reactors, comprising:

a thick-walled open-top closed-bottom metallic cylindrical body for shielding gamma radiation from radioactive substances carried therein, said body having a circular interior cavity and a counterbore in its top;

a detachable lining for said cavity of corrosion resistant material, said lining having a top peripheral flange overlying the bottom of said counterbore;

a thick metallic cover for said lining disposed in said counterbore for shielding gamma radiation from radioactive substances carried in said lining;

sealing means interposed between the opposed surfaces of said flange and said lining cover inwardly of the periphery of said flange;

fastening means for said lining extending through said flange into said container body; and bolts extending through said cover into tapped sockets inside said fastening means for detachably fastening said cover to said body independently of the fastening of said lining to said body.

2. The structure defined in claim 1 including: a second counterbore in the top of said body outwardly of the first-mentioned counterbore;

an outside cover disposed in said second counterbore;

sealing means interposed between the opposed surfaces of said outside cover and the bottom of said second counterbore inwardly of the periphery of said outside cover;

means detachably securing said outside cover to the body outwardly of said sealing means; and means defining a test connection having a removable closure therefor and extending through said outside cover for monitoring the interspace between the interior enclosure formed by said lining and its cover and the outer enclosure formed by said body and said outside cover.

* * * * *